United States Patent [19]

Blankenship et al.

[11] 4,196,713

[45] Apr. 8, 1980

[54] FUEL BURNING HEATER

[75] Inventors: Jack D. Blankenship; Clarence R. Smith, both of Birmingham, Ala.

[73] Assignee: Atlanta Stove Works, Inc., Atlanta, Ga.

[21] Appl. No.: 883,394

[22] Filed: Mar. 6, 1978

[51] Int. Cl.[2] ..... F24C 1/14

[52] U.S. Cl. ..... 126/77; 126/83; 126/60

[58] Field of Search ..... 126/60, 61, 58, 65, 126/77, 83

[56] References Cited

U.S. PATENT DOCUMENTS

| | | | |
|---|---|---|---|
| 564,817 | 7/1896 | Barrier | 126/61 |
| 4,127,100 | 11/1978 | Baker | 126/61 |

FOREIGN PATENT DOCUMENTS

| | | | |
|---|---|---|---|
| 65319 | 11/1942 | Norway | 126/77 |

*Primary Examiner*—Carroll B. Dority, Jr.
*Attorney, Agent, or Firm*—Woodford R. Thompson, Jr.

[57] ABSTRACT

A fuel burning heater has a lower combustion chamber with a door at the front thereof and an upper heating chamber with a discharge port for products of combustion at the rear thereof. A common wall between the heating chamber and a portion of the combustion chamber defines a bottom for the heating chamber and at least a portion of a top for the combustion chamber. A discharge passageway through the common wall conveys products of combustion into the heating chamber with means directing at least a portion of the products of combustion toward the front of the heating chamber. Draft regulators in the lower portion of the door introduce controlled amounts of combustion air for fast burning and other draft regulators in the upper portion of the door introduce controlled amounts of combustion air for slow burning.

8 Claims, 4 Drawing Figures

Fig 3
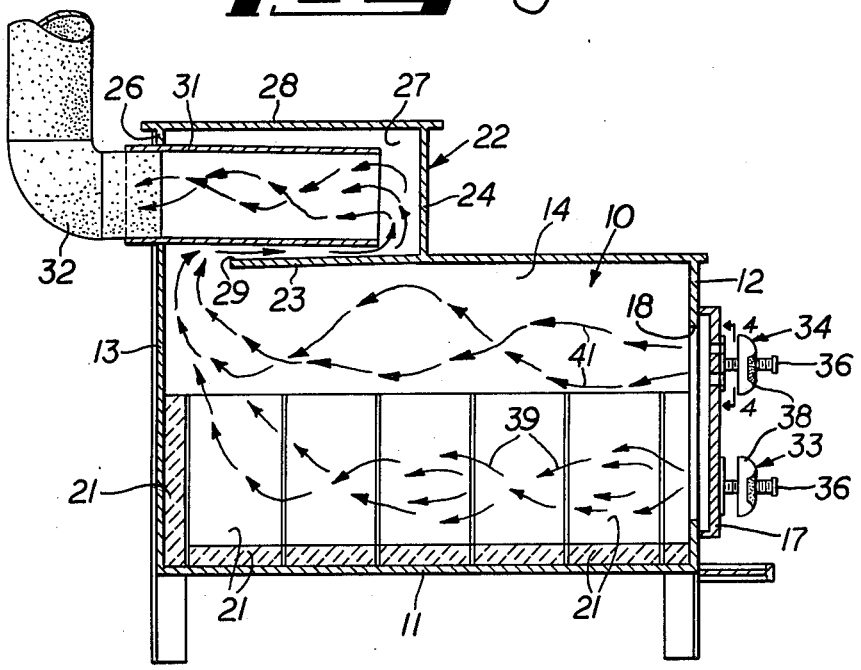
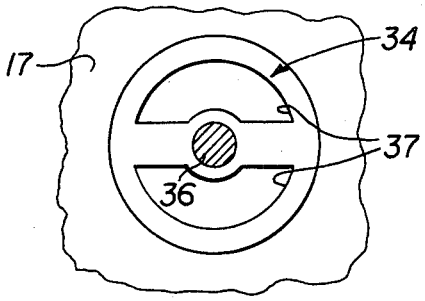
Fig 4
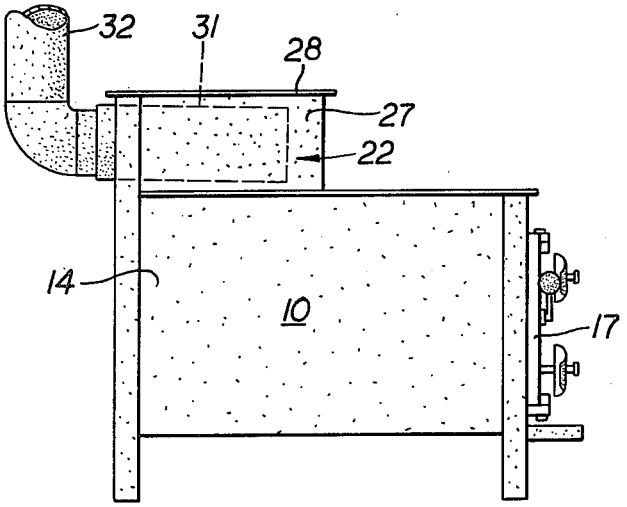
Fig 1
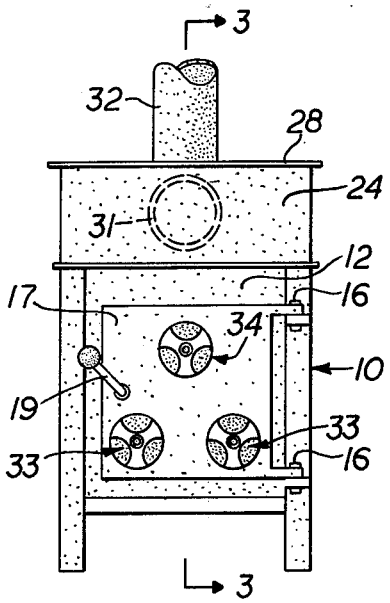
Fig 2

FUEL BURNING HEATER

BACKGROUND OF THE INVENTION

This invention relates to a fuel burning heater and more particularly to such a heater which shall include improved means for regulating the flow of air through the heater whereby the fuel, such as wood, may be burned at selected rates. That is, by adjusting the draft system to one position, the combustion air is introduced into the lower, forward portion of the combustion chamber and then flows upwardly through a heating chamber prior to being discharged. Upon adjusting the drafting system to another position, the combustion air is introduced into the upper, forward portion of the combustion chamber whereby the air then moves in a gentle manner above the wood or other fuel and then passes upwardly into a heating chamber prior to being discharged from the heater.

Heretofore in the art to which our invention relates, many fuel burning heaters have been devised wherein the combustion air is circulated in various paths through the heater prior to being discharged. However, such heaters are not only complicated in structure but they fail to provide a draft system which provides for fast starts and quick heat-up and also reduced draft and slow burning when a long sustaining radiant fire is desired. Such prior art heaters with which we are familiar are as follows: U.S. Pat. Nos. 96,328, 1,320,276, 1,536,786, 1,564,567, 1,603,925, 1,892,015, 2,313,370, and 2,315,809.

SUMMARY OF THE INVENTION

In accordance with our invention, we overcome the above and other difficulties by providing a fuel burning heater having a lower combustion chamber with a front door and an upper heating chamber with a discharge port for products of combustion at the rear thereof. The heating chamber is separated from the combustion chamber by a common wall which defines a bottom for the heating chamber and at least a portion of the top for the combustion chamber. A discharge passageway is provided through the common wall for conveying products of combustion into the heating chamber. Improved means is provided for directing at least a portion of the products of combustion toward the front end of the heating chamber whereby the combustion gases and heat from such gases are maintained inside the heater for a longer period of time, thereby minimizing loss of heat through the outlet flue. Draft regulators are provided in the lower portion of the door of the heater for introducing controlled amounts of combustion air into the lower portion of the combustion chamber whereby the air then passes into direct contact with the wood or other fuel and provides for fast burning. A draft regulator is mounted in the upper portion of the door of the heater for introducing controlled amounts of combustion air into the combustion chamber at an elevation above the wood or other fuel, thereby reducing the draft and providing secondary combustion air above the burning wood or other duel whereby the wood is burned at a slow rate, thus particularly adapting the furnace for holding a fire at night.

DESCRIPTION OF THE DRAWING

A fuel burning heater embodying features of our invention is illustrated in the accompanying drawing, forming a part of this application, in which:

FIG. 1 is a side elevational view;

FIG. 2 is a front elevational view thereof;

FIG. 3 is an enlarged, sectional view taken generally along the line 3—3 of FIG. 2; and FIG. 4 is an enlarged, fragmental view taken generally along the line 4—4 of FIG. 3.

DETAILED DESCRIPTION

Referring now to the drawing for a better understanding of our invention, we show a lower housing which defines a combustion chamber 10 having a bottom wall 11 connected to a front wall 12, a rear wall 13 and upstanding side walls 14. Hingedly connected to one side of the front wall 12 by suitable hinges 16 is a door 17 which opens and closes a feed opening 18 provided in the front wall 12, as shown in FIG. 3. The door 17 is provided with a suitable latch member 19 for securing the door in closed position. Also, as shown in FIG. 3, firebrick 21 may be mounted on the bottom wall 11 and alongside the lower portions of the side walls 14 and rear wall 13.

Mounted above the combustion chamber 10 is an upper housing which defines a heating chamber 22. A common wall 23 is mounted between the combustion chamber 10 and the heating chamber 22 with the rear portion of the common wall 23 defining a bottom for the heating chamber 22. The common wall 23 is provided with a forwardly extending portion which extends over the forward portion of the combustion chamber 10 whereby the wall 23 provides an upper wall for the combustion chamber 10. The chamber 22 is provided with an upstanding front wall 24, a rear wall 26 and side walls 27 which are connected at their upper ends to a top wall 28.

As shown in FIG. 3, a discharge passageway 29 is provided through the rear portion of the common wall 23 for conveying products of combustion from the combustion chamber 10 into the chamber 22. As shown in FIG. 3, the rear end of a tubular member 31 extends through a suitable opening provided in the rear wall 26 of the heating chamber 22 with the forward end of the tubular member 31 terminating adjacent and in spaced relation to the front wall 24 of the heating chamber 22. As shown in FIGS. 2 and 3, the under surface of the tubular member 31 is spaced above the wall 23 while the upper surface of the tubular member 31 is spaced from the under surface of the top wall 28 for the heating chamber 22. The rearmost end of the tubular member 31 receives a conventional flue pipe indicated generally at 32. While the tubular member 31 is shown as being round, it will be apparent that the member 31 may be of other suitable shapes. It will thus be seen that the tubular member 31 defines deflector means for directing the products of combustion entering the heating chamber 22 toward the front thereof prior to passage of the products of combustion to the discharge port or flue pipe 32.

As shown in FIG. 3 the tubular member 31 slopes upwardly and rearwardly toward the rear wall 26 of the heating chamber whereby the products of combustion are drawn through the tubular member 31 by the natural draft created therein. Also, by sloping the tubular member 31 upwardly and rearwardly, any distillate, such as creosote, will run downwardly and forwardly toward the front wall 24. The portion of the wall 23 forming the bottom of the heating chamber 22 slopes downwardly and rearwardly toward the passageway 29 whereby the products of combustion passing through passageway 29 are drawn toward the receiving end of the tubular member 31 by natural draft while any distillate flowing onto the wall 23 is conveyed toward passageway 29 whereupon it enters the combustion chamber 10.

As shown in FIGS. 2 and 3, horizontally spaced draft regulators 33 are carried by the lower portion of the door 17 and have suitable passageways therethrough for introducing controlled amounts of combustion air into the lower portion of the combustion chamber 10 for fast burning of fuel. At least one draft regulator 34 is carried by the upper portion of the door for introducing controlled amounts of combustion air into the upper portion of the combustion chamber 10 for slow burning of fuel. As shown in FIG. 2, the upper draft regulator 34 is preferably mounted in a vertical plane which passes between the horizontally spaced regulators 33. The draft regulators 33 and 34 are shown as being identical and each comprises a threaded member 36 which is carried by and projects forwardly and outwardly of the door 17. Suitable vent passageways 37 are provided through the door 17 adjacent the threaded member 36, as shown in FIG. 4. A suitable control knob 38 is carried by each threaded member 36 for movement selectively toward and away from the vent passageways 37.

As shown in FIGS. 1 and 3, the heating chamber 22 is shown as extending approximately one-half the length of the combustion chamber 10 whereby the products of combustion entering the rear portion of the heating chamber 22 pass a substantial distance forwardly prior to passing into the receiving end of the tubular member 31 whereby the combustion gases and heat from such gases are maintained inside the heater unit for a longer period of time, thereby minimizing loss of heat through the outlet flue 32.

From the foregoing description, the operation of our improved fuel burning heater will be readily understood. For fast burning of the fuel, such as would occur when a fire is first started, the lower draft regulators 33 are opened and the upper regulator 34 is closed whereby combustion air enters the lower portion of the combustion chamber 10 and passes therethrough generally in the direction of the arrows 39. Accordingly, the combustion air passes directly in contact with the wood or other fuel positioned in the lower portion of the combustion chamber. The lower draft regulators 33 thus provide primary air below the fire which brings about a faster burning of the wood or other fuel. To provide for slow burning of the fuel, such as where it is desired to hold the fire at night, the draft regulators 33 are closed while the upper draft regulator 34 is opened. The combustion air then passes into the upper portion of the combustion chamber and passes therethrough generally in the direction of the arrows 41 to provide secondary air above the wood or other fuel. Accordingly, the combustion air passing through the draft regulators 34 into the upper portion of the combustion chamber 10 moves in a gentle manner above the wood and then passes upwardly through the discharge passageway 29 into the heating chamber 22.

It will thus be seen that the products of combustion leaving either the lower portion of the combustion chamber 10 or the upper portion of the combustion chamber 10 pass through the discharge passageway 29 into the rear portion of the heating chamber 22 whereupon the products of combustion then flow forwardly alongside the top and bottom of the tubular member 31 as well as alongside the sides of the tubular member 31. Upon reaching the forward end of the heating chamber 22, the products of combustion then pass rearwardly into the tubular member 31 and then are finally discharged through the outlet port or flue pipe 32.

From the foregoing it will be seen that we have devised an improved fuel burning heater which is simple of construction, economical of manufacture and one which is particularly adapted for supplying combustion air selectively for fast burning of the fuel and slow burning of the fuel. By providing draft regulators 33 in the lower portion of the combustion chamber which supply combustion air into the lower portion of the combustion chamber whereupon the products of combustion then flow upwardly through the discharge passageway 29, fast burning of the fuel is provided. By closing the upper draft regulator 34 while the lower draft regulators 33 are open, all of the incoming combustion air passes through the lower portion of the combustion chamber 10 into direct contact with the fuel, such as wood. By closing the lower draft regulators 33 and opening the upper draft regulator 34, the fire may be held overnight. If more heat is desired, the lower draft regulators 33 are turned whereby they are opened to introduce the desired amount of combustion air. Accordingly, by adjusting the lower draft regulators 33 and the upper draft regulators 34 to selected positions, the amount of air passing in direct contact with the wood and the amount of air passing over the wood in the upper portion of the combustion chamber may be readily varied to maintain the fire whereby it burns at the desired rate. In actual practice, we have found that with proper draft adjustment and with the proper amount of wood loaded in the combustion chamber, the fire can be held for 12 to 17 hours.

While we have shown our invention in but one form, it will be obvious to those skilled in the art that it is not so limited but is susceptible of various changes and modifications without departing from the spirit thereof.

What we claim is:

1. A fuel burning heater comprising:

(a) a lower housing defining a combustion chamber with a door at the front thereof, (b) an upper housing defining a heating chamber above said combustion chamber with a discharge port for products of combustion at the rear of said heating chamber, (c) a common wall between said upper housing and at least a portion of said lower housing defining a bottom wall for said heating chamber and at least a portion of a top wall for said combustion chamber, (d) means including said common wall forming an opening between said combustion chamber and said heating chamber adjacent the rear end of said combustion chamber, (e) means located within said heating chamber directing at least a portion of said products of combustion entering said heating chamber toward the front thereof prior to passage of said products of combustion to said discharge port, (f) at least one draft regulator in the lower portion of said door for introducing controlled amounts of combustion air into the lower portion of said combustion chamber for fast burning of fuel, and (g) at least one draft regulator in the upper portion of said door for introducing controlled amounts of combustion air into the upper portion of said combustion chamber for slow burning fuel.

2. A fuel burning heater as defined in claim 1 in which said draft regulator in the lower portion of said door comprises horizontally spaced regulators and said draft regulator in the upper portion of said door comprises an upper regulator disposed in a vertical plane passing between said horizontally spaced regulators.

3. A fuel burning heater as defined in claim 1 in which said opening between said combustion chamber and said heating chamber is adjacent the rear end of said common wall and said means directing said products of combusion toward the front of said heating chamber comprises a deflector member extending forwardly of said opening with the forward end of said deflector member terminating in spaced relation to the forward end of said heating chamber so that the products of combustion entering said heating chamber pass to the forward end of said deflector member and then pass rearwardly to said discharge port.

4. A fuel burning heater as defined in claim 3 in which said deflector member is a downwardly and forwardly sloping tubular member having its rearmost end in communication with said discharge port.

5. A fuel burning heater as defined in claim 3 in which the portion of said common wall defining a bottom wall for said heating chamber slopes downwardly and rearwardly toward said opening between combustion chamber and said heating chamber.

6. A fuel burning heater as defined in claim 4 in which said tubular member is generally cylindrical in shape.

7. A fuel burning heater as defined in claim 1 in which said heating chamber extends approximately one-half the length of said combustion chamber.

8. A fuel burning heater as defined in claim 1 in which each of said draft regulators comprises a threaded member carried by and projecting outwardly of said door with there being vent passageways through said door adjacent said threaded member and a control member is threadedly connected to said threaded member for movement selectively toward and away from said vent passageways.

* * * * *